United States Patent [19]

Soler

[11] 4,137,579

[45] Feb. 6, 1979

[54] URINE DRAIN

[76] Inventor: Peter S. Soler, P.O. Box 87, Covina, Calif. 91723

[21] Appl. No.: 862,346

[22] Filed: Dec. 20, 1977

[51] Int. Cl.[2] ..... E03D 13/00; A61F 5/44

[52] U.S. Cl. ..... 4/311; 4/144.3; 128/295

[58] Field of Search ..... 4/1, 301, 311, 114, 4/340–342, 144.1, 144.3, 262, 263; 285/196, 338; 128/295

[56] References Cited

U.S. PATENT DOCUMENTS

| | | | |
|---|---|---|---|
| 3,295,148 | 1/1967 | Deeley, Jr. et al. | 4/263 |
| 3,336,602 | 8/1967 | Kubit | 4/301 |
| 3,458,871 | 8/1969 | Valcervo | 4/3 |
| 3,500,480 | 3/1970 | Michal, Jr. | 4/1 X |
| 3,602,923 | 9/1971 | Girala | 128/295 X |
| 3,735,428 | 5/1973 | Olivero | 4/311 X |
| 3,742,522 | 7/1973 | Stevenson | 4/311 X |
| 3,964,110 | 6/1976 | Kapit | 4/301 X |

FOREIGN PATENT DOCUMENTS

| | | | |
|---|---|---|---|
| 734849 | 8/1955 | United Kingdom | 285/196 |

*Primary Examiner*—Stuart S. Levy

*Attorney, Agent, or Firm*—Robert K. Wallor

[57] ABSTRACT

The Urine Drain is a combination plumbing fixture having an irregularly shaped receptacle member, generally configured as a deeply concave bowl with a drain neck portion depending downward and rearward; a drain tube, attached at its upper end to said drain neck and to a miniature P-trap at its lower end; said P-trap, which is coupled to a standard toilet drain by expandable grommet means; and a fresh water supply line, running from the toilet water supply pipe or other source to an attachment coupling affixed to the receptacle member. Said receptacle member has a hollow handle, rigidly formed and attached to the rearward portion of said receptacle, said handle serving as the fresh water distribution and control means to supply a tubular hollow rim of said receptacle member. Said hollow rim contains a multiplicity of holes distributed about the periphery of said rim for use in flushing and rinsing said receptacle member. Variations are provided for both the fresh water attachment means, enabling a selection of the water source, and in the drain attachment to the toilet or other drain means. A functional eye is provided as an integral part of the receptacle member to enable storage of the urine drain between uses.

5 Claims, 8 Drawing Figures

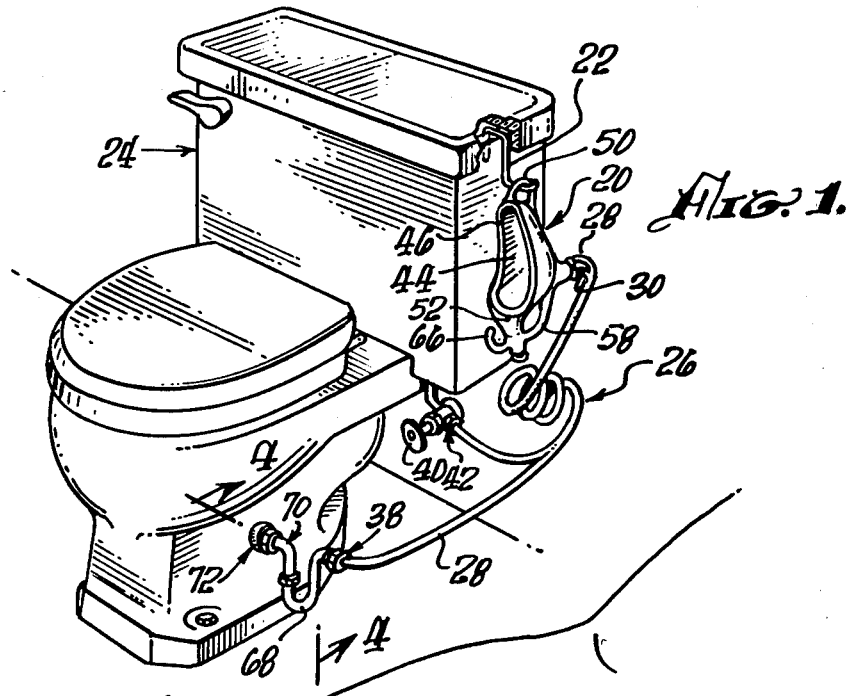
FIG. 1.
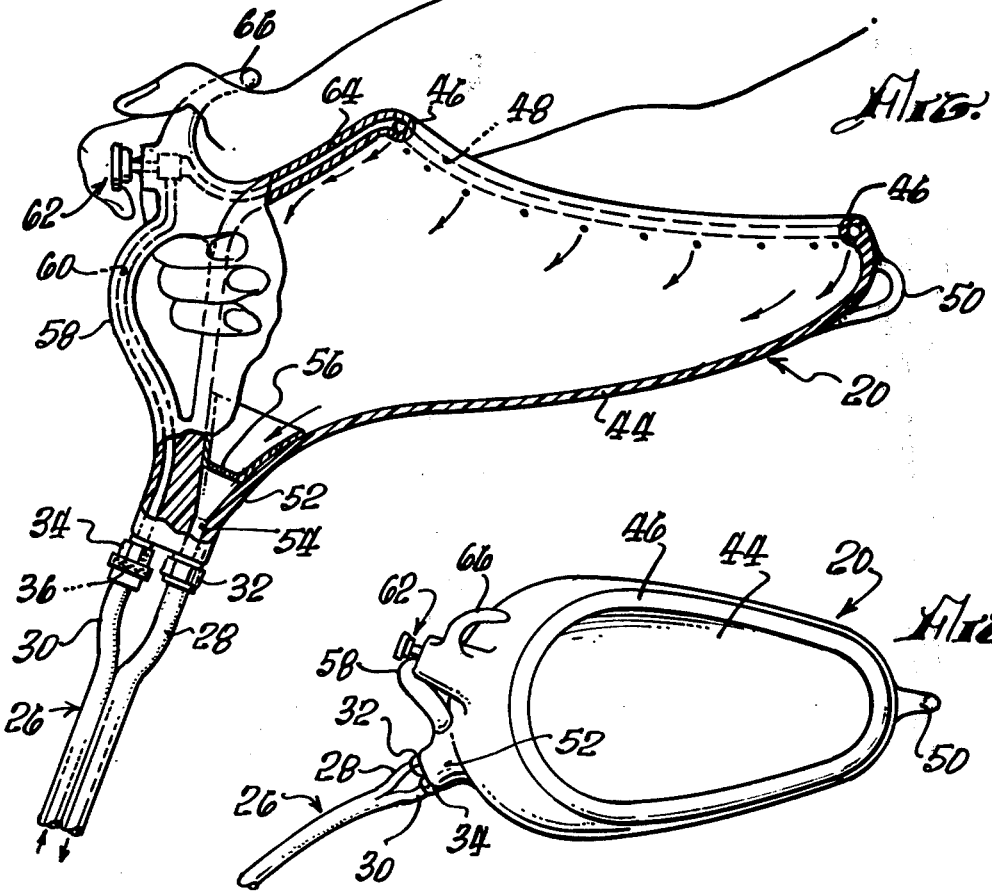
FIG. 2.
FIG. 3.

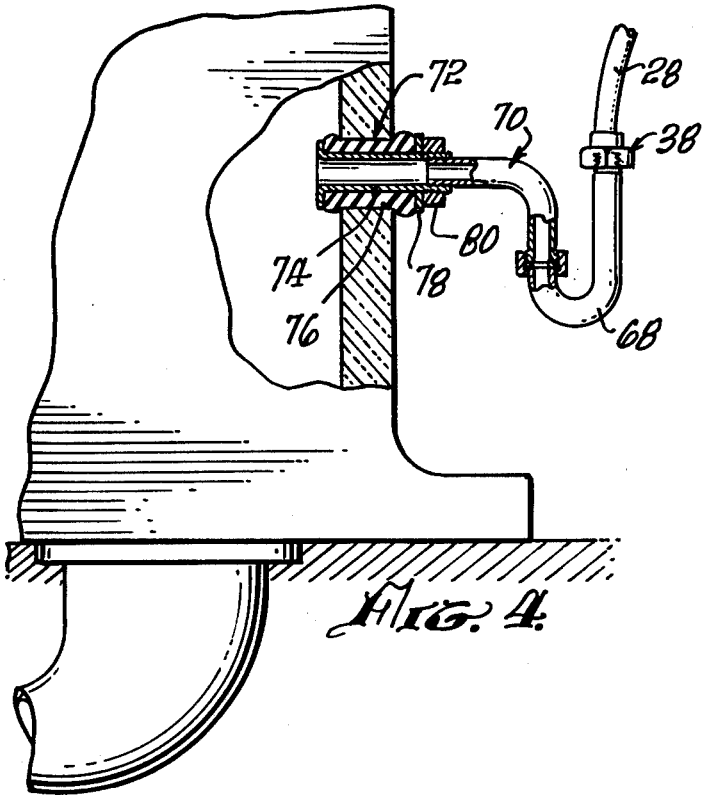
FIG. 4.
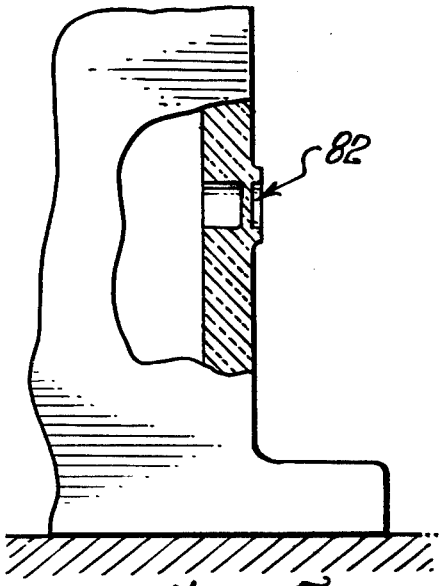
FIG. 5.
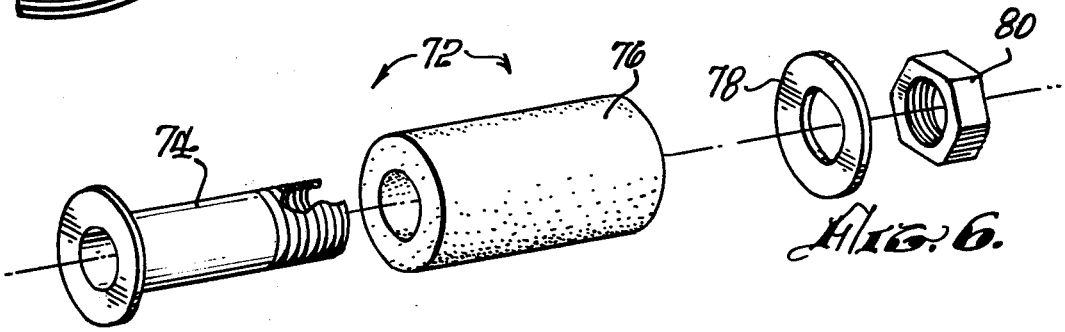
FIG. 6.
FIG. 7.
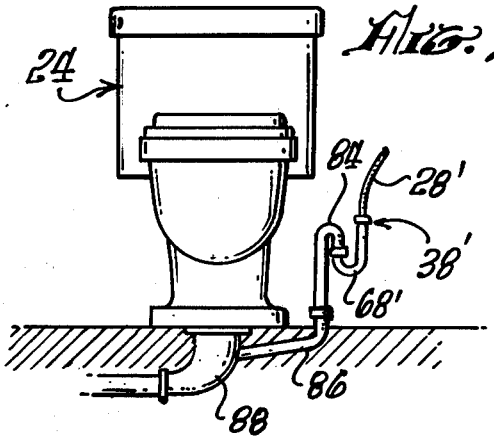
FIG. 8.
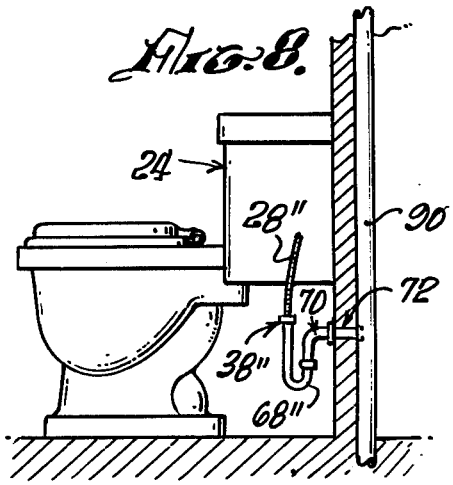

URINE DRAIN

BACKGROUND OF THE INVENTION

This invention relates to a unisexually configured urinal attachment for either conventional or specially configured toilet bowls, and, more particularly, a urinal attachment which is intended to utilize a separate flushing water supply, and which utilizes the drain facilities associated with the conventional toilet presently common to residential and other installations.

As is well known, the normal toilet bowl can be utilized by either sex for urinary purposes, although, particularly for adult male individuals, while in a standing position, some degree of unsuitability arises from splashing, and for objectionable cascading noise. Further, it is well known that the flushing of the standard toilet bowl after a single urinary use constitutes a significant waste of fresh water. Even incorporation of currently available water conservation devices and techniques does not appreciably reduce the fresh water wastage, since they must provide sufficient flow to dispose of solid wastes.

Prior efforts to alleviate the problem of water wastage are found in prior art. Most notable are the U.S. Pat. Nos. held by T. T. Kubit (3,336,602), John H. Michal, Jr. (3,412,408), and Wayne Kapit (3,964,110). The present invention differs significantly from these in the method of utilization, the manner of attachment to the conventional toilet, and in the technique of flushing water management.

The earliest of the cited U.S. Pat. No. 3,336,602 (Kubit) is based upon a specially constructed toilet assembly requiring a dual flush mechanism as part of the tank assembly and a costly bowl configuration. By its design it does not appear to alleviate the above-mentioned unsuitabilities for use by standing male individuals.

U.S. Pat. No. 3,412,408 (Michal) provides a partial solution to the unsuitabilities mentioned above in that the urination process occurs into the duct member which is then flushed into the standard toilet bowl by diverting a portion of the water filling the tank after a normal flushing operation to a holding reservoir within the duct. However, this system still requires periodic normal flushing of the toilet for its operation, which operation is not required by the present invention.

The Portable Unisex Urinal of U.S. Pat. No. 3,964,110 (Kapit) does not require a standard toilet installation for its use. It does, however, produce several inconveniences not present in the present invention in that its use is inconvenienced by the mounting method on the bathtub rim. Depending upon the plumbing installations available within a given residence, such attachment may not be feasible. This device further requires manual filling of its flushing reservoir tank.

SUMMARY OF THE INVENTION

The nature of the invention herein described concerns the combination of a receptacle member, a drain tube and trap, an insert means, a flushing water supply line, a flushing control valve, and their interelationships.

The receptacle member is configured so as to provide a receptacle for urinary purposes suitable for use by individuals of either sex. Outwardly convex exterior side regions, an internal lip about the periphery of the receptacle opening, and an elongated, downward neck provide assurance against splashback upon the user's person through the shape of the interior surfaces of the receptacle. Typically directed urine streams will impinge upon said internal surfaces such that the rebounding liquid is uniformly directed downward into the elongated neck region. An off-center handle, flushing valve, and thumbgrip structure is rigidly incorporated into said receptacle member to provide for one-hand support and operation during use. The opposite end of said receptacle member has an integrally formed eye on its exterior for storing said receptacle member in a hanging position between periods of use. The dimensions of said receptacle are such that the user will not be subjected to discomfort during use, even though the receptacle member be placed adjacent to the user's urinary orifice. Moreover, it is contemplated that a protective coating material, similar to that used on currently produced, soft toilet seats, will be affixed to those surfaces of the receptacle member that are likely to come in physical contact with the user's groin or leg areas.

The elongated downward neck contains coupling to a flexible, extendable drain tube, which, in turn, is coupled directly to the sewage line through a miniature trap inserted through the toilet body by a special insert means, or alternately through the floor to a modified "closet bend", or alternately through the wall into the sewage vent pipe and drain. A removable filter is included within said neck region of the receptacle member to prevent solid material from clogging said drain line, or miniature trap. Said filter is so constructed as to minimize or impede splashing of liquid incident upon it in a generally downward direction.

A parallel flexible, extendable flushing water line is affixed to a fresh water supply by sealable coupling means and to a second coupling situated on the receptacle member neck region. This flushing water line and the drain line are formed such that they comprise a two-channel conduit except for such separations as are necessary to provide for the couplings at either end.

The flushing water enters a separate channel fabricated within the handle portion of the receptacle member and, through a push-to-open, release-to-close valve, thence into a channel within the peripheral lip of the receptacle member. Said lip contains a multiplicity of small holes distributed such that the interior surface area of the receptacle member is rinsed during the flushing operation.

It is the principal purpose of the present invention to provide a highly effective, sanitary, inexpensive, convenient, and easily operated unisex urinal attachment which is readily capable of being installed relative to conventional toilet bowls, and is arranged to provide relatively noiseless use thereof by individuals of either sex, and simple and effective flushing means which precludes odor return from the drain, all with the use of a minimal quantity of flushing water.

Another object of the invention is to provide, essentially a bowl-like urinal arrangement adjustably positionable for use, either standing or sitting, by incapacitated individuals, such that splashing is avoided, and such that the urinal attachment may be positioned when not in use so as not to interfere with the normal use of the toilet.

A further object of the invention provides the capability for drain installation by the user in either standard, existing toilets or into specially configured toilets or plumbing and for use of either the toilet water supply or any available water tap as the source for the flushing water.

BRIEF DESCRIPTION OF THE DRAWINGS

FIG. 1 is a perspective view showing an exemplary embodiment of the urine drain attachment incorporating the principles of the present invention and illustrated as being connected to a conventional toilet bowl and water supply, with the receptacle member disposed in its stored position.

FIG. 2 illustrates, generally, a sectional view of the receptacle member showing the drain coupling, filter, and flushing water supply routing, and shown in phantom, the manner in which the receptacle is held and the flush valve is operated during use.

FIG. 3 presents a vertical view of the receptacle member illustrating the general shape thereof and indicating the offset position of the handle, valve, and thumbgrip.

FIG. 4 is a partial sectional view of the trap and connection arrangement used at the lower end of the drain line as the installation into a standard toilet bowl.

FIG. 5 is a partial sectional view of a specially fabricated toilet bowl containing a punch-out provision for insertion of the drain line of the present invention.

FIG. 6 presents an enlarged, exploded view of the self-sealing insert used for the drain installation.

FIG. 7 presents an alternate trap and drain installation wherein a specially fabricated closet bend is built into the bathroom floor.

FIG. 8 presents a further alternate installation wherein the drain is placed directly into the sewage vent pipe and drain within the wall of the bathroom using conventional threaded attachment means.

DESCRIPTION OF THE PREFERRED EMBODIMENTS

Primarily for purposes of relating the essential parts of the present invention to conventional toilet facilities, the several figures contain views of said conventional toilet facilities or portions thereof for reference. Where specific portions or parts of said conventional toilet facilities are referred to in the following description, appropriate reference numbering will be employed.

The preferred embodiment of the present invention is illustrated in perspective, as stored, in FIG. 1, in cross section in FIG. 2 and in plan view in FIG. 3. These illustrations include the embodiment of the attachment means used for storing the urine drain when not in use, details of which are described hereinafter. The urine drain illustrated in these figures primarily comprises a structure generally designated as the receptacle member 20 which comprises a plurality of different elements which are also described in detail hereinafter.

Referring now to FIG. 1, the embodiment of the hanger means 22 permits storage of the receptacle member 20 along the side of the tank 24 of a conventional toilet. Said hanger means 22 is not a part of the present invention but is referred to for clarity in showing the stored position of the present invention. Similarly, the hanger means 22 is shown as placed upon the right side of the tank 24, as viewed, whereas said stored position of the urine drain may as readily be found upon the left side of said tank 24. The general orientation of the receptacle member 20 during use and its operation will be described in detail hereinafter.

FIG. 1 also shows the general configuration of a dual-channel flexible tube 26 which utilizes one line to provide a flushing water supply to said receptacle member 20, with the other line serving as the drain line from said receptacle member 20 to a trap and insert assembly which shall be more fully described in detail hereinafter. Said dual-channel flexible tube 26 has a small portion near the points of attachment to the receptacle member 20 wherein the drain line 28 and the flushing water supply line 30 are physically separated and no longer joined as a dual-channel tube, in order to permit mechanical operation of the fluid tight attachment means 32, 34, respectively. In line with the flushing water supply line 30 and forming a part of the fluid tight attachment means 34 is located a filter element 36, so situated as to preclude particulate matter from flowing into the receptacle member 20. Said dual-channel flexible tube 26 also separates at its lower extremity into a separate drain line 28 and flushing water supply line 30. The lower end of the drain line 28 is coupled to the trap and insert assembly, described in detail hereinafter, by fluid tight coupling means. The lower end of the flushing water supply line 30 is coupled to the conventional toilet water supply system, at or near the toilet water supply shut-off valve 40 by a fluid tight coupling means 42.

Referring now to FIG. 2, the receptacle member 20 is comprised of an irregularly shaped, rigidly formed, bowl member 44, which in use assumes the generally horizontal position illustrated. The upper portion of said bowl member 44 contains an opening through which the urine is introduced. Surrounding said opening is a lip 46 configured so as to constrict the size of the opening to prevent splashback. Within said lip 46 is an annular manifold 48 containing a plurality of holes directed to the inner wall of said bowl member 44, said holes being so distributed as to direct flushing water from the annular manifold 48 downward along the inner walls of said bowl member 44. As illustrated, at the right extremity of the bowl member 44 is a rigidly formed eye loop 50 which engages the hanger means 22 of FIG. 1 for storage of the urine drain.

At the left extremity of the bowl member 44 the irregular shape is further distorted to form an elongated neck region 52 leading generally downward to the drain outlet 54 and the fluid tight attachment means 32. A truncated conical filter screen 56 is removably placed within the neck region 52 to preclude solid matter from passing downward through the drain line 28.

Rigidly attached to the left most outer wall of the bowl member 44 is the handle assembly 58 containing an internal channel 60 for passing the flushing water from its fluid tight attachment means 34 to a plunger type valve means 62. A second internal channel 64 directs the flushing water from said valve means 62 to the annular manifold 48.

Referring now to FIGS. 2 and 3, it is shown that the handle assembly 58 is situated generally off the longitudinal axis of the receptacle member 20 such that the user may comfortably hold the unit with three fingers through the handle assembly 58 and the thumb engaging a thumb grip 66, thereby leaving the index finger free to operate the valve means 62.

Referring now to FIG. 4, the lower extremity of the drain line 28 is coupled to the trap and insert assembly by fluid tight coupling means 38. Said trap and insert assembly is comprised of a miniature version of a standard "P"-trap 68 which is coupled by threaded means to a right-angle miniature standard elbow 70, which is in turn coupled by threaded means to a self-sealing insert assembly 72 which passes through the wall of the base of a standard toilet into the drain cavity below the trap contained within such a standard toilet through a specially drilled hole.

The construction of the self-sealing insert assembly 72 is illustrated in FIG. 6. A tube 74, of sufficient length to pass through the toilet base wall, containing at one end a flange of larger diameter than the basic outer diameter of said tube and having both internal and external threads found over a portion of the tube length from the opposite end of said tube, is inserted through a right circular annular cylindrical sleeve 76 formed of a resilient, compressible, material, said sleeve being retained on said tube by said flange. A rigid washer 78 is then passed over the threaded end of said tube adjacent to said sleeve. A nut 80 engages the external threads of said tube. After coupling the aforementioned elbow 70 to the internal threads of tube 74, the entire assembly is inserted into the specially drilled hole in the toilet base wall such that the flange on said tube enters a minimal distance into the interior drain cavity. The nut 80 is then tightened upon its threads, causing the washer 78 to compress the sleeve 76, longitudinally, which in turn expands radially to seal the drilled hole.

Upon completion of all indicated connections, the present invention can be used by grasping the receptacle member 20 as described hereinabove and inserting it between the user's legs to the groin region such that urination will occur into the opening of the bowl member 44. Upon completion of the urination, the user will activate the valve means 62, causing a minimal amount of flushing water to drain the urine through drain line 28 and trap 68 into the sewage access located below the toilet base. The unit may be stored after use and flushing by engaging the eye loop 50 upon the hanger means 22.

MODIFICATION AND OTHER EMBODIMENTS

Referring now to FIG. 5, the first modification consists of obtaining from the manufacturers of standard toilet bowls, a specially fabricated toilet bowl having a circular "punch-out" provision 82 formed into the tolet base wall, said "punch-out" having the appropriate diameter to accept the insert assembly 72 of FIG. 4. The balance of the present invention is not changed and is herein included.

A further modification to the drain mechanization is illustrated in FIG. 7, wherein the right angle elbow 70 of FIG. 4 is replaced by an 180° elbow 84. Said drain assembly, without the insert assembly, is thence coupled by fluid tight coupling means to a tubular extension 86 of appropriate diameter, specially formed as part of, or rigidly attached to, the standard "closet bend" 88 which forms the toilet-to-sewer connection in standard toilet installations. The closet bend 88 is entirely beneath floor level while the tubular extension 86 will be of sufficient length and elevation to provide access, removed from the base area of the toilet, for mechanically coupling the drain system for the present invention.

A further mechanization of drainage attachment is shown in FIG. 8 wherein the drain line 28, trap 68, and elbow 70, of FIG. 4 are passed through the bathroom wall beneath the tank 24 whereupon the drain is affixed to an opening in the standard vent pipe and drain 90 found in standard plumbing installations, by fluid tight threaded means.

An additional modification utilizes a standard adapter on the lower extremity of the flushing water supply line such that a standard water tap, such as is found in standard sinks, can be used as the source for the flushing water. Moreover, omission of the trap, elbow, and insert assembly from the lower extremity of the drain line would permit placing the drain line directly into the drain of a sink, bathtub floor drain, or other sewage disposal situs.

While the invention has been described and illustrated in its several preferred embodiments, it should be understood that the invention is not to be limited to the precise details herein illustrated and described since the same may be carried out in other ways falling within the scope of the invention as claimed.

I claim:

1. A urine drain system comprised of a receptacle member; a flexible, extendable tubular drain line; a flexible, extendable tubular flushing water supply line; valve means for controlling the flow of the flushing water; fluid tight coupling means for joining said drain line and said flushing water supply line to said receptacle member; removable filter means situated in said flushing water supply line; a second removable filter means situated in the drain outlet region of said receptacle member; fluid tight coupling means for joining said flushing water supply line to a source of flushing water, and a P-trap and insert assembly for coupling the discharge end of said drain line to the sewage outlet of a standard plumbing installation; said combination being interconnectd so as to provide for the passage of flushing water from a pressurized source through said flushing water supply line, coupling, and removable filter means, into a handle rigidly affixed to said receptacle member, said handle containing an internally enclosed tubular passage for said flushing water leading to said valve means, also situated within said handle, and said handle additionally containing a second internally enclosed, tubular passage for said flushing water leading from said valve means to an annular water passage contained within a lip formed about a generally ovoid opening in said receptacle member, providing for the entry of urine from the user's person, said annular passage containing a plurality of holes distributed about the periphery of said lip such that the flushing water, when released by said valve means, is directed downward along the internal surface of said receptacle member, carrying urine downward toward an outlet region formed into said receptacle member, through said second filter means removably situated therein, and into said drain line, whereupon the liquid is transferred by gravity out of said discharge end of said drain line; said receptacle member being further configured so as to comfortably fit in close proximity to a standing user of either sex while being held in one hand; and said valve means being positioned on said handle such that on finger of the holding hand may operate the flushing system.

2. The combination of claim 1 wherein said insert assembly is placed within a pre-formed hole of a specially fabricated toilet base; said hole providing direct access to the sewage outlet cavity of said toilet installation.

3. The combination of claim 1 wherein said drain line and P-trap are coupled by fluid tight coupling means to a specially fabricated extension tube formed as a part of the closet bend required for standard toilet installation.

4. The combination of claim 1 wherein said drain line and P-trap are coupled by fluid tight coupling means to the sewage vent pipe and drain located within the room wall of the standard toilet installation.

5. The combination of claim 1 wherein said flushing water supply line is coupled by fluid tight coupling means to a standard water tap or spigot.

* * * * *